US005953769A

United States Patent [19]

Williams

[11] Patent Number: 5,953,769

[45] Date of Patent: Sep. 21, 1999

[54] BATHTUB SEAT

[76] Inventor: Pamela D. Williams, 4418 Mowery Rd., Houston, Tex. 77047

[21] Appl. No.: 09/135,458

[22] Filed: Aug. 17, 1998

[51] Int. Cl.[6] ..... A47K 3/022

[52] U.S. Cl. ..... 4/578.1; 4/560.1; 297/411.26; 297/344.21

[58] Field of Search ..... 4/578.1, 579, 560.1, 4/611, 571.1, 577.1; 297/115, 411.3, 411.2, 411.21, 411.26, 411.27, 344.21, 344.26

[56] References Cited

U.S. PATENT DOCUMENTS

| | | | |
|---|---|---|---|
| 3,196,465 | 7/1965 | Montgomery | 4/185 |
| 3,290,090 | 12/1966 | Ford | 297/118 |
| 4,166,297 | 9/1979 | Saleeby | 4/185 |
| 4,472,844 | 9/1984 | Mace | 4/579 |
| 4,475,256 | 10/1984 | Hatala | 4/579 |
| 5,103,509 | 4/1992 | Richards | 4/564.1 |
| 5,226,183 | 7/1993 | Clark | 4/560.1 |
| 5,335,377 | 8/1994 | Masyada et al. | 4/578.1 |
| 5,361,428 | 11/1994 | Nanowsky et al. | 4/579 |
| 5,746,479 | 5/1998 | Bodnar | 297/411.26 |

*Primary Examiner*—David J. Walczak
*Attorney, Agent, or Firm*—Henderson & Sturm

[57] ABSTRACT

A tub mountable seat device having feet adapted to grip the bottom of a bathing tub and having a pair of removable armrests securable to opposed sides thereof. A center pivot is provided that supports a seat and backrest arrangement that can pivot in a 360 degree fashion only when the armrests are removed. The seat is restricted from pivoting when either of the armrests is secured in place.

5 Claims, 1 Drawing Sheet

BATHTUB SEAT

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of bathtub accessories, and more particularly to a bathtub seat.

2. Description of Related Art

As can be seen by reference to the following U.S. Pat. Nos. 3,196,465; 3,290,090; 4,166,297; 4,472,844; 5,103,509; and 5,335,377, the prior art is replete with myriad and diverse bathtub seats.

While all of the aforementioned prior art constructions are more than adequate for the basic purpose and function for which they have been specifically designed, they are uniformly deficient with respect to their failure to provide a simple, efficient, and practical bathtub seat.

As a consequence of the foregoing situation, there has existed a longstanding need for a new and improved bathtub seat and the provision of such a construction is a stated objective of the present invention.

BRIEF SUMMARY OF THE INVENTION

Briefly stated, the present invention provides a tub mountable seat device having feet adapted to grip the bottom of a bathing tub and having a pair of removable armrests securable to opposed sides thereof. A center pivot is provided that supports a seat and backrest arrangement that can pivot in a 360 degree fashion only when the armrests are removed. The seat is restricted from pivoting when either of the armrests is secured in place.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
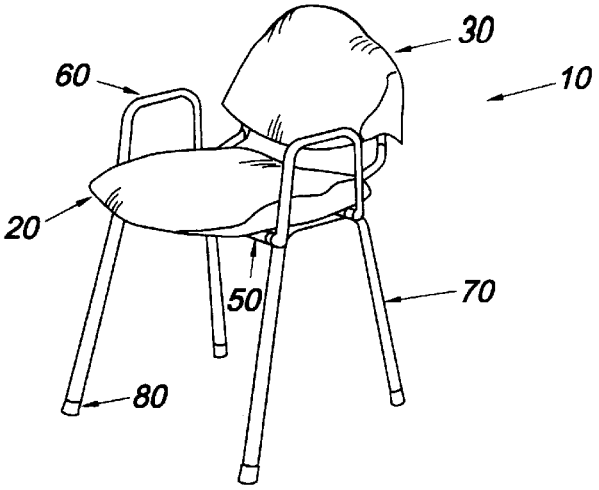
FIG. 1 is a perspective view of the bathtub seat of the present invention.
Figure 2:
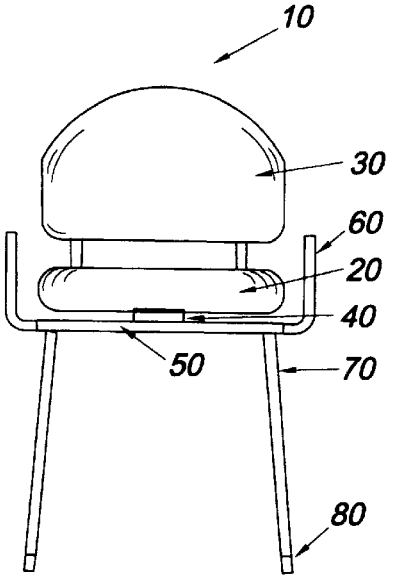
FIG. 2 is a front elevational view thereof.
Figure 3:
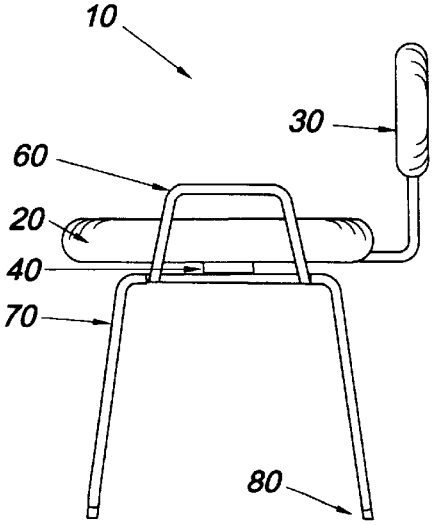
FIG. 3 is a side elevational view thereof.

As can be seen by reference to the drawings, and in particularly to FIG. 1, the bathtub seat that forms the basis of the present invention is designated generally by the reference number 10. The seat 20 and backrest 30 of the bathtub seat 10 are constructed of molded, heavy duty plastic and conform to the body. The backrest 30 is adjustable for greater comfort, if needed. The seat is attached to a swivel base 40 which in turn is attached to the aluminum horizontal cross members 50. Two arm rests 60 extend out from the ends of the horizontal members 50 and are removable. The legs 70 are constructed of tubular aluminum in an inverted "V" shape, allowing for stability. The ends of the legs 70 carry rubber caps 80 to grip the bottom of the tub to prevent the bathtub seat 10 from slipping.

In use, a medical professional, or other home health care worker places the bathtub seat 10 into the tub, removing the armrests 60. The seat 20 is then rotated facing out from the tub. The patient is then helped into the tub, and placed onto the seat 20. The seat 20 is then rotated back into the normal position and the armrests 60 reinserted into the horizontal cross members 50. The patient is then bathed in the usual fashion. If necessary, the backrest 30 is adjusted for greater comfort of the patient.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A bathtub seat comprising:

a pair of inverted V-shaped leg members disposed in spaced relationship;

a horizontal cross member attached to and interconnecting the leg members;

a swivel base attached above and centrally of the horizontal cross member;

a seat portion attached to and carried by the swivel base and being movable between a forward directed position and a side directed position; and a pair of armrests releasably attached to the horizontal cross member and being disposed to extend out from and above the seat portion, each of the armrests acting to prevent the movement of the seat portion from the forward directed position when they are attached to the horizontal cross member.

2. The bathtub seat of claim 1 further including:

a back portion attached to the seat portion and disposed to extend upwardly therefrom.

3. The bathtub seat of claim 2 wherein the back portion is formed of plastic.

4. The bathtub seat of claim 1 further including slip resistant caps attached to the bottom of the leg members.

5. The bathtub seat of claim 1 wherein the seat portion is formed of plastic.

* * * * *